US012522427B2

(12) United States Patent
Wang et al.

(10) Patent No.: US 12,522,427 B2
(45) Date of Patent: Jan. 13, 2026

(54) CONTAINERS AND SYSTEMS FOR MEDICAL DEVICE TRANSPORTATION

(71) Applicant: SHANGHAI UNITED IMAGING HEALTHCARE CO., LTD., Shanghai (CN)

(72) Inventors: Meng Wang, Shanghai (CN); Jilong Yin, Shanghai (CN); Zhenhui Zheng, Shanghai (CN)

(73) Assignee: SHANGHAI UNITED IMAGING HEALTHCARE CO., LTD., Shanghai (CN)

( * ) Notice: Subject to any disclaimer, the term of this patent is extended or adjusted under 35 U.S.C. 154(b) by 505 days.

(21) Appl. No.: 18/058,856

(22) Filed: Nov. 25, 2022

(65) Prior Publication Data

US 2024/0033030 A1 Feb. 1, 2024

(30) Foreign Application Priority Data

Jul. 29, 2022 (CN) ..... 202221995773.4
Jul. 29, 2022 (CN) ..... 202221995802.7

(51) Int. Cl.
*B65D 88/54* (2006.01)
*B65D 19/44* (2006.01)
*B65D 90/00* (2006.01)

(52) U.S. Cl.
CPC ..... *B65D 88/546* (2013.01); *B65D 19/44* (2013.01); *B65D 90/006* (2013.01); *B65D 2519/00348* (2013.01); *B65D 2519/00815* (2013.01)

(58) Field of Classification Search
CPC .... B65D 90/006; B65D 88/546; B65D 88/54; B65D 19/44; B60P 1/52; F16L 3/13; B65H 75/366
See application file for complete search history.

(56) References Cited

U.S. PATENT DOCUMENTS 3,847,091 A * 11/1974 Holt ..... B61D 45/008 410/128
4,395,172 A * 7/1983 Hoener ..... B64D 9/003 410/84
2013/0015288 A1* 1/2013 Hernandez ..... F16L 3/13 248/223.41
2020/0039414 A1* 2/2020 Ruan ..... B65D 90/0033
2021/0261034 A1* 8/2021 Soto ..... B60P 1/52

FOREIGN PATENT DOCUMENTS

CN 108584180 A * 9/2018 ..... B65D 85/68
GB 2431981 A * 5/2007 ..... F17C 13/007
WO WO-2018041317 A1 * 3/2018 ..... B65H 75/36

* cited by examiner

*Primary Examiner* — Daniel J Colilla
(74) *Attorney, Agent, or Firm* — METIS IP LLC

(57) ABSTRACT

A container for medical device transportation is provided. The container may include a body including a cavity for accommodating a medical device; a support for supporting the medical device; and a guiding mechanism for guiding the support to move from an entrance of the body to a target position in the cavity.

20 Claims, 7 Drawing Sheets

CONTAINERS AND SYSTEMS FOR MEDICAL DEVICE TRANSPORTATION

CROSS-REFERENCE TO RELATED APPLICATIONS

This application claims priority of Chinese Patent Application No. 202221995773.4 filed on Jul. 29, 2022, and Chinese Patent Application No. 202221995802.7, filed on Jul. 29, 2022, the entire contents of each of which are hereby incorporated by reference.

TECHNICAL FIELD

The present disclosure relates to the field of medical device transportation, in particular, to containers and systems for medical device transportation.

BACKGROUND

Generally, a medical device or a portion (e.g., a superconducting magnet of a magnetic resonance imaging (MRI) device) thereof needs to be accommodated in a container for long-distance transportation. At present, the medical device is usually loaded in or out of the container with a forklift, which is inefficient and inaccurate. In addition, vent pipes configured to connect the medical device and a compressor in the container are generally fixed in an inner beam of the container by tedious steps which is waste of time and/or manpower. Due to the above-mentioned limitations, one container can only transport one medical device, which also improves transportation costs. Therefore, it is desirable to provide an improved container for medical device transportation, thereby improving transportation efficiency and reducing transportation costs.

SUMMARY

As an aspect of the present disclosure, a container is provided. The container may include a body including a cavity for accommodating a medical device; a support for supporting the medical device; and a guiding mechanism for guiding the support to move from an entrance of the body to a target position in the cavity.

In some embodiments, the guiding mechanism may include a guiding slot disposed on a bottom surface of the support; and a plurality of guiding assemblies disposed on a bottom surface of the body and arranged in a row along a longitude direction of the body. The guiding slot may work with the plurality of guiding assemblies to guide the support to the target position.

In some embodiments, the guiding assembly may include a pair of guiding units each of which includes a support rod and a guiding wheel that is rotationally connected with the support rod. An end of the support rod may be fixedly connected with the bottom surface of the body. An outer surface of the guiding wheel may touch a sidewall of the guiding slot.

In some embodiments, the container may further include a rolling mechanism for assisting the support to move from the entrance of the body to the target position in the cavity.

In some embodiments, the rolling mechanism may include a rolling slot disposed on a bottom surface of the support; and a plurality of rolling units disposed on a bottom surface of the body and arranged in a row along a longitude direction of the body. The rolling slot may work with the plurality of rolling units to assist the support to the target position.

In some embodiments, the rolling unit may include a mounting base and a rolling body that is rotationally connected with the mounting base. An end of the mounting base may be fixedly connected with the bottom surface of the body. An outer surface of the rolling body may touch an upper surface of the rolling slot.

In some embodiments, a buffer layer may be set between the mounting base and the bottom surface of the body.

In some embodiments, the rolling mechanism may include a first rolling part disposed on two sides with respect to a center line of the body along a longitude direction of the body; and a second rolling part disposed in a vicinity of the entrance of the body.

In some embodiments, the container may further include a guiding block disposed in a vicinity of an end of the second rolling part that is close to the entrance of the body.

In some embodiments, the guiding block may have a V-shape facing towards the second rolling part.

In some embodiments, the container may further include a baffle disposed on each of two sidewalls of the body along a longitude of the body.

In some embodiments, a damping layer may be disposed on the upper surface of the support.

In some embodiments, the container may further include a vent pipe. At least a portion of the vent pipe may be disposed on a sidewall of the body.

In some embodiments, the container may further include a buckle for clamping the vent pipe, wherein the buckle is disposed on the sidewall of the body.

In some embodiments, the buckle may include two gripping arms that form a sticking slot for clamping the vent pipe.

In some embodiments, each of the gripping arms may include a clamping part and a slide guiding part. The slide guiding part may tilt along a direction away from the clamping part and extending outward.

In some embodiments, the container may further include a wire spool for winding at least a portion of the vent pipe. The wire spool may be disposed on a sidewall of the body.

In some embodiments, the wire spool may include a main part; one or more connection parts fixedly connected with the sidewall of the body; and one or more position limitation parts, an end of each of which may be fixedly connected with an outer surface of the main part and another end of each of which may protrude outward along a radial direction of the main part.

In some embodiments, the connection parts or the position limitation parts may be arranged in intervals along a circumferential direction of the main part.

As another aspect of the present disclosure, a system for medical device transportation is provided. The system may include a container. The container may include a body including a cavity for accommodating a medical device; a support for supporting the medical device; and a guiding mechanism for guiding the support to move from an entrance of the body to a target position in the cavity.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
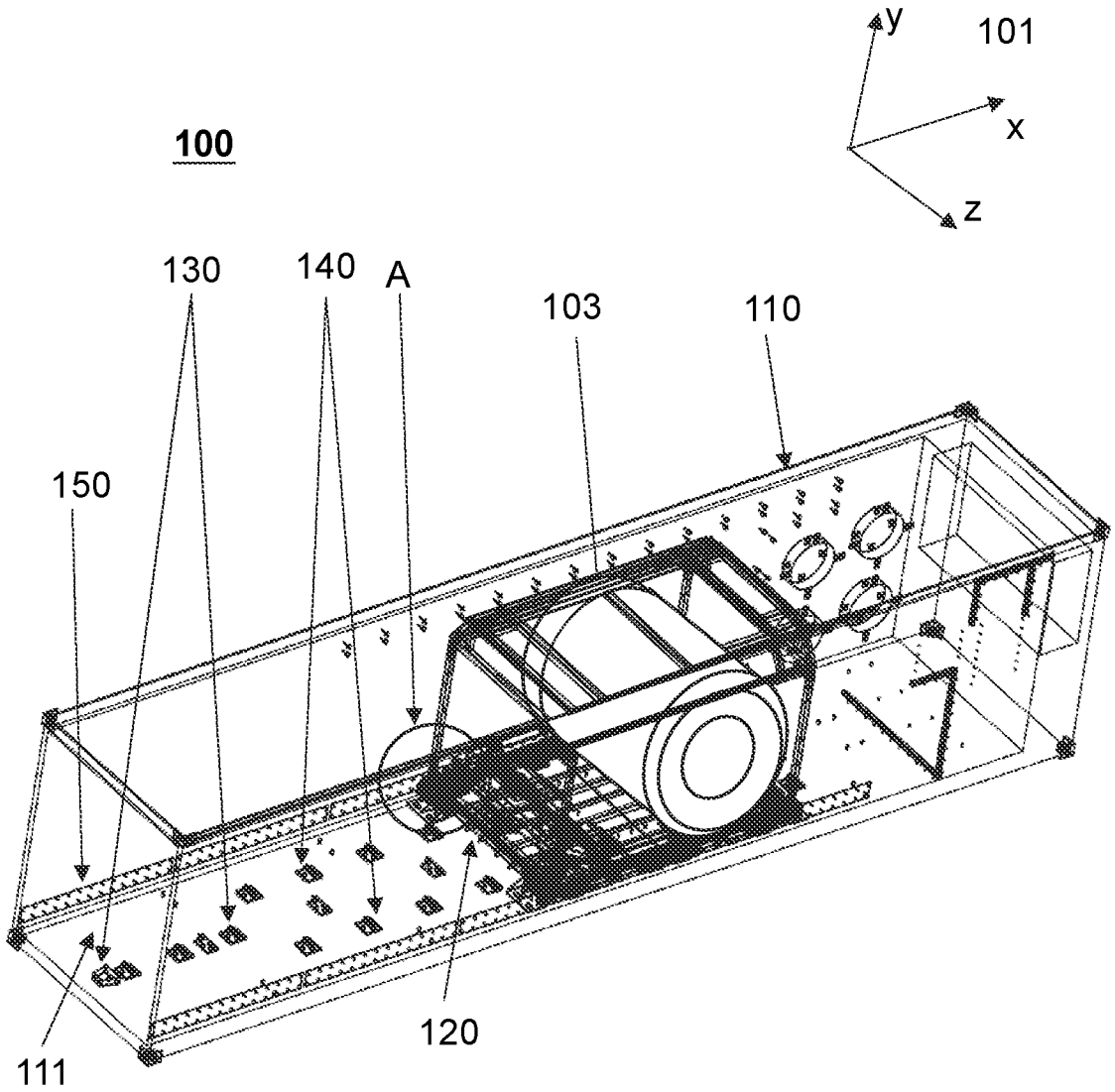
FIG. 1 is a schematic diagram illustrating an exemplary container for medical device transportation according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when a unit, engine, module, or block is referred to as being "on," "connected to," or "coupled to," another unit, engine, module, or block, it may be directly on, connected or coupled to, or communicate with the other unit, engine, module, or block, or an intervening unit, engine, module, or block may be present, unless the context clearly indicates otherwise. As used herein, the term "and/or" includes any and all combinations of one or more of the associated listed items.

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure. It is understood that the drawings are not to scale.

For illustration purposes, the following description is provided to help better understand the present disclosure. It is understood that this is not intended to limit the scope of the present disclosure. For persons having ordinary skills in the art, a certain amount of variations, changes, and/or modifications may be deducted under the guidance of the present disclosure. Those variations, changes, and/or modifications do not depart from the scope of the present disclosure.

Generally, a medical device needs to be accommodated in a container for long-distance transportation. Before transportation, the medical device needs to be fixed on a support (e.g., a pallet) and then packaged with the support as a whole. At present, the medical device is usually loaded in and/or out of the container by a forklift. During the loading of the medical device into the container, the forklift lifts the support with the medical device fixed thereon and adjusts the support with the medical device fixed thereon to an appropriate position, and then the forklift moves the support with the medical device fixed thereon to an entrance of the container by a fork of the forklift. Due to the limited length of the fork of the forklift, the medical device can't directly reach a target position in the container, and the support with the medical device fixed thereon needs to be pushed to the target position by the fork of the forklift. Similarly, during the loading of the medical device out of the container, the support with the medical device fixed thereon needs to be pulled to an appropriate position (e.g., the entrance of the container) by the forklift via a rope or strap, and then the forklift loads the support with the medical device fixed thereon out of the container by the fork of the forklift.

In such cases, at least two operators (e.g., a forklift driver and at least one construction personnel) are needed for completing the loading of the medical device. For example, during the loading of the medical device, a construction personnel is needed to help the forklift driver to move the support with the medical device fixed thereon to reach a desired position (e.g., the target position or the entrance in the container smoothly and slowly. The construction personnel should also pay attention to the distance between the medical device and a sidewall of the container to prevent the medical device from scratching the sidewall. In a situation where the distance between the medical device and the sidewall of the container is too small (e.g., smaller than a preset distance), the construction personnel would remind the forklift driver to make adjustments (e.g., adjust the support to an appropriate position). The process of loading the medical device is greatly affected by human factors and is inefficient and inaccurate. In addition, due to the limited size of the forklift and/or the medical device, one container can only load one medical device by the forklift, which increases the transportation cost.

Therefore, it is desirable to provide an improved container for medical device transportation, which can improve transportation efficiency and reduce transportation cost.

In one aspect of the present disclosure, a container for medical device transportation is provided. In another aspect, a system including the container for medical device transportation is provided. The container may include a body including a cavity for accommodating a medical device. The container may also include a support for supporting the medical device. The container may also include a guiding mechanism for guiding the support to move from an entrance of the body to a target position in the container. In some embodiments, the container may further include a rolling mechanism for assisting the support to move from the entrance of the body to the target position in the cavity. According to the combination of the guiding mechanism and the rolling mechanism, the support can be moved between an entrance of the container and the target position smoothly and efficiently, and more than one medical device can be loaded in the container which reduces the transportation cost.

FIG. 1 is a schematic diagram illustrating an exemplary container for medical device transportation according to some embodiments of the present disclosure. As shown in FIG. 1, the container 100 may include a body 110, a support 120, and a guiding mechanism 130.

For illustration purposes, a coordinate system 101 is provided for describing the container 100. The coordinate system 101 may include an x-axis, a y-axis, and a z-axis. The x-axis is along a longitude direction of the container 100. The y-axis is along a height direction of the container 100. The z-axis is along a width direction of the container 100.

The body 110 may include a cavity for accommodating a medical device 103. In some embodiments, the body 110 may include an upper surface (or an upper wall), a bottom surface (or a bottom wall), two end surfaces (or end walls), and two side surfaces (or sidewalls) which form the cavity. The upper surface and the bottom surface may be parallel to the x-z plane. The two end surfaces may be parallel to the y-z plane. The two side surfaces may be parallel to the x-y plane. In some embodiments, the medical device 103 may be a medical imaging device (e.g., a single-modality imaging device or multimodality imaging device), a medical treatment device, or the like, or any combination thereof, or a portion thereof. For example, the medical device 103 may include a magnetic resonance imaging (MRI) device or a superconducting magnet thereof, a computed tomography (CT) device, a positron emission computed tomography (PET) device, a PET-MRI device, a PET-CT device, etc. As another example, the medical device 103 may include an image-guided radiotherapy device (e.g., an MRI-guided radiotherapy device).

In some embodiments, the body 100 may include an entrance 111 through which the medical device 103 can be loaded in and/or out of the container 100. The end surface of the body 111 where the entrance 111 is located may be detachable. For example, the end surface of the body 110 where the entrance 111 is located may be disassembled to allow the medical device 103 to be loaded in and/or out of the container 100. As another example, after the medical device 103 is loaded in the container 100, the end surface of the body 110 where the entrance 111 is located may be reassembled to seal the container 100.

The support (also referred to as a pallet) 120 may be configured to support the medical device 103. For example, the medical device 103 may be fixed on the support 120 before the medical device 103 is transported. As another example, the medical device 103 may be transmitted (e.g., loaded in and/out of the container 200) through the movement of the support 12. As still another example, the medical device 103 may be fixed in the container 100 by the support 120. More descriptions regarding the support 120 may be found elsewhere in the present disclosure (e.g., FIGS. 2A and 2B and the descriptions thereof).

The guiding mechanism 130 may be configured to guide the support 120 to load in and/or out of the container 100. For example, the guiding mechanism 130 may guide the support 120 to move from the entrance 111 of the body 110 to a target position in the container 100. As used herein, the target position may refer to a position in the cavity of the body 110 where the medical device 103 is to be fixed. As another example, the guiding mechanism 130 may guide the support 120 to move from the target position in the container 100 to the entrance 111 of the body 110.

Figure 2A:
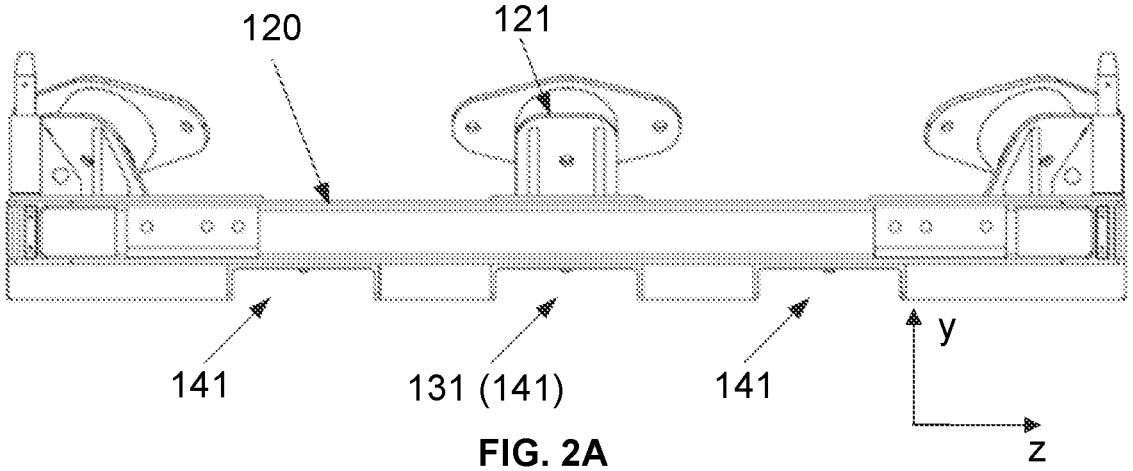
FIGS. 2A, 2B, and 3 are schematic diagrams illustrating an exemplary guiding mechanism and an exemplary rolling mechanism with respect to the support and/or the bottom surface of the body according to some embodiments of the present disclosure.
Figure 2B:
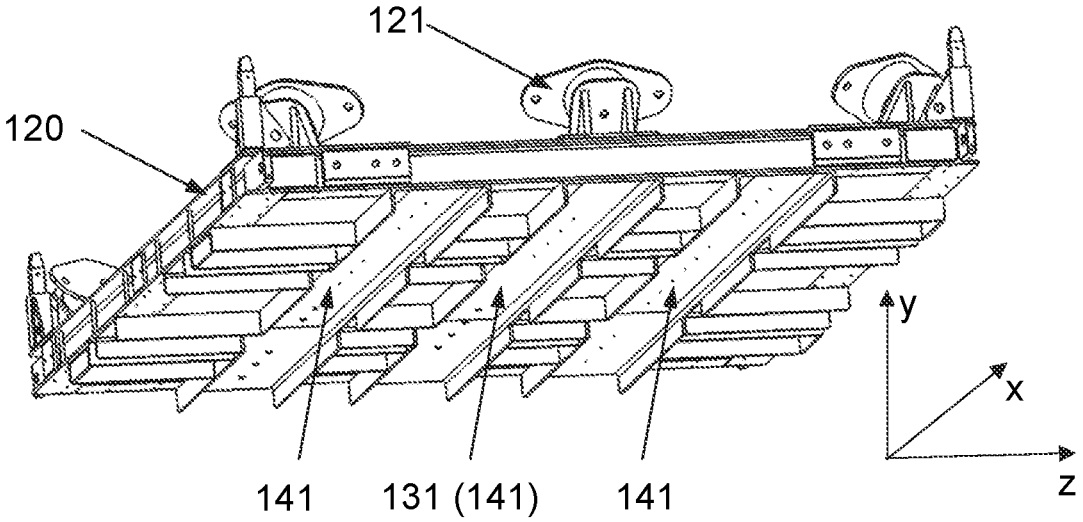
Figure 3:
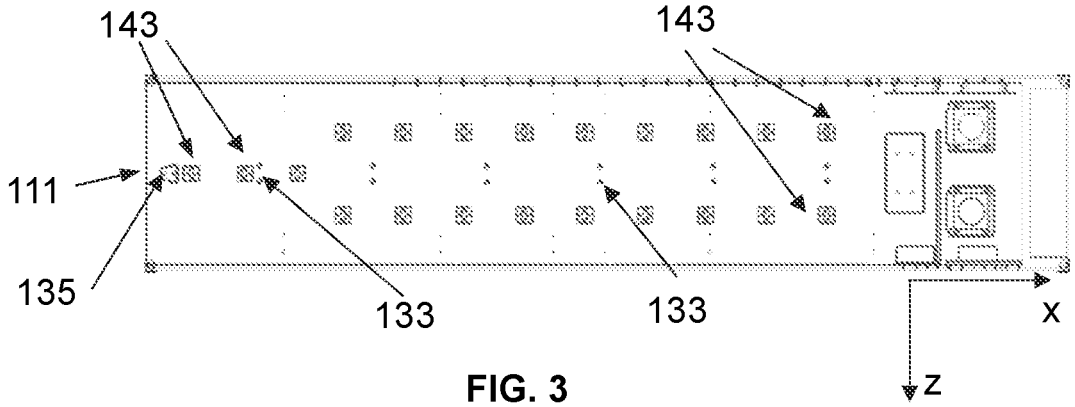

In some embodiments, the guiding mechanism 130 may include a guiding slot (e.g., a guiding slot 131 shown in FIGS. 2A and 2B) and a plurality of guiding assemblies (e.g., a plurality of guiding assemblies 133 shown in FIG. 3). The guiding slot may be disposed on a bottom surface of the support 120. The plurality of guiding assemblies may be disposed on the bottom surface of the body 110 and arranged in a row along a longitude direction (e.g., a direction parallel to the x-axis) of the body 110. In some embodiments, the guiding slot may work with the plurality of guiding assemblies to guide the support 120 to the target position. For example, the guiding slot may be set (e.g., buckled) on the plurality of guiding assemblies and moveable along an arrangement direction (e.g., the longitude direction of the body 110). Thus, the support 120 may move with the medical device 103 along the arrangement direction of the plurality of guiding assemblies under the cooperation/action of the guiding slot and the plurality of guiding assemblies. More descriptions regarding the guiding mechanism 130 may be found elsewhere in the present disclosure (e.g., FIGS. 2A, 2B, 3, 4A, and 4B and relevant descriptions thereof).

In some embodiments, the container 100 may further include a rolling mechanism 140. The rolling mechanism 140 may be configured to assist the support 120 to move between the entrance 111 of the body 110 and the target position in the cavity. For example, the rolling mechanism 140 may assist the support 120 to move from the entrance 111 to the target position in the cavity for loading the medical device 103 in the container 100. As another example, the rolling mechanism 140 may assist the support 120 to move from the target position in the cavity to the entrance 111 for loading the medical device 103 out of the container 100.

In some embodiments, the rolling mechanism 140 may include a rolling slot (e.g., a rolling slot 141 shown in FIGS. 2A and 2B) and a plurality of rolling units (e.g., a plurality of rolling units 143 shown in FIG. 3). The rolling slot may be disposed on a bottom surface of the support 120. The plurality of rolling units may be disposed on the bottom surface of the body 110 and arranged in a row along the longitude direction (e.g., a direction parallel to the x-axis) of the body 110. In some embodiments, the rolling slot may work with the plurality of rolling units to assist the support 120 to move between the entrance 111 and the target position. For example, the plurality of rolling units may be used as one or more guiding rails. When the support 120 is moving (e.g., sliding) on the plurality of rolling units, the plurality of rolling units may provide a support for the support 120 and form a sliding function with the rolling slot. Thus, the support 120 can move with the medical device 103 under a relatively small force (e.g., a small push/pull force). More descriptions regarding the guiding mechanism 140 may be found elsewhere in the present disclosure (e.g., FIGS. 2A, 2B, 3, and 5 and relevant descriptions thereof).

In some embodiments, the container 100 may also include a baffle 150 configured to protect the sides walls of the body 110 of the container 100 from being scratched by the support 120 and/or the medical device 103, especially when the support 120 is moving with the medical device 103 in the cavity of the body 110. In some embodiments, the baffle 150 may be disposed on a lower end of one of the two sidewalls of the body 110 along the longitude direction (e.g., a direction parallel to the z-axis) of the body 110. In some embodiments, the container 100 may include two baffles 150 each of which is disposed on one of the two sidewalls of the body 110. That is, the baffle 150 may be disposed on each of the two sidewalls of the body 110. Alternatively, the container 100 may include only one baffle 150 disposed on a lower end of one of the two sidewalls of the body 110. In some embodiments, the material of the baffle 150 may include plastic, aluminum alloy, stainless steel, alloy plastic steel, or the like, or any combination thereof.

Figure 12:
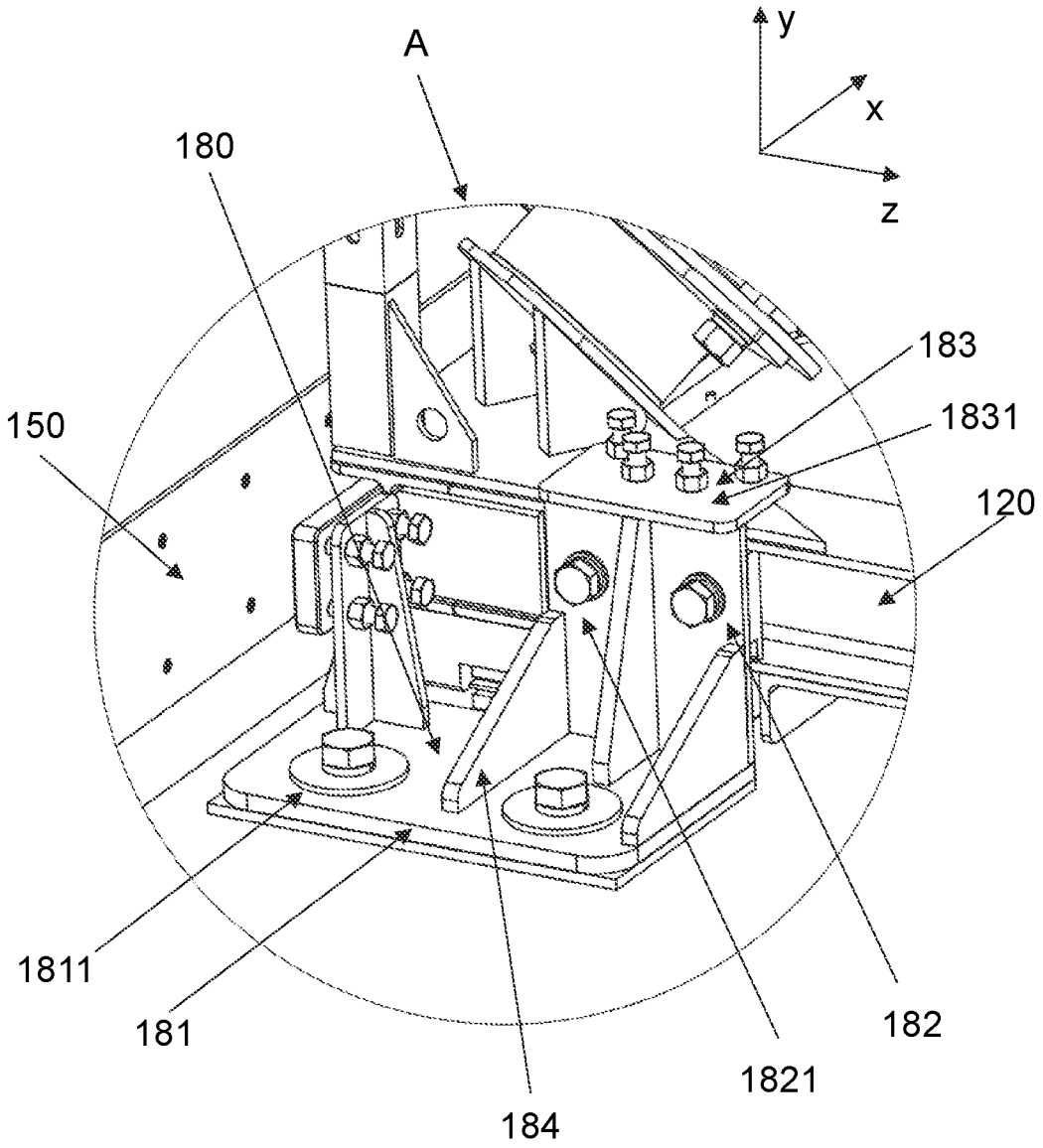
FIG. 12 is a schematic diagram illustrating an exemplary fixing mechanism for fixing the support according to some embodiments of the present disclosure.

In some embodiments, after the support 120 and the medical device 103 reach the target position, the support 120 may be fixed on the bottom surface of the container 100 by one or more fixing mechanisms (e.g., a fixing mechanism 180 illustrated in FIG. 12). More descriptions regarding the fixing mechanism may be found elsewhere in the present disclosure (e.g., FIG. 12 and relevant descriptions thereof).

It should be noted that the descriptions of the container 100 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

FIGS. 2A, 2B, and 3 are schematic diagrams illustrating an exemplary guiding mechanism and an exemplary rolling mechanism with respect to the support and/or the bottom surface of the body according to some embodiments of the present disclosure.

As illustrated, the guiding mechanism 130 may include a guiding slot 131 and a plurality of guiding assemblies 133.

The guiding slot 131 may be disposed on the bottom surface of the support 120. In some embodiments, the guiding slot 131 may be arranged along the longitude direction (e.g., a direction parallel to the x-axis) of the body 110 of the container 100. For example, the guiding slot 131 may be arranged along a center line of the body 110 along the longitude direction of the body 110. In some embodiments, the guiding slot 131 may have a left sidewall and a right sidewall that are parallel to the x-y plane and an upper wall that is parallel to the x-z plane to form a slot shape.

The plurality of guiding assemblies 133 may be disposed on the bottom surface of the body 110 of the container 100. In some embodiments, the plurality of guiding assemblies 133 may be arranged in a row along the longitude direction (e.g., a direction parallel to the x-axis) of the body 110 of the container 100. For example, as illustrated in FIG. 3, the plurality of guiding assemblies 133 are arranged in a row along a center line of the body 110 along the longitude direction of the body 110. In some embodiments, the plurality of guiding assemblies 133 may be arranged at intervals along the longitude direction of the body 110.

In some embodiments, the guiding mechanism 130 may be configured to guide the support 120 to move between the entrance 111 of the body 110 and the target position in the cavity of the body 110 through the guiding slot 131 and the plurality of guiding assemblies 133. For example, the guiding slot 131 may be bucked on the plurality of guiding assemblies 133 and movable along the arrangement direction of the plurality of guiding assemblies, such that the medical device 103 fixed on the support 120 can be moved between the entrance 111 and the target position smoothly and quickly, thereby improving the efficiency of loading the medical device 103 in and/or out of the container 100.

In some embodiments, a guiding assembly 133 may include a pair of guiding units. In some embodiments, each guiding unit of the pair of guiding units may include a support rod (e.g., a support rod 411 illustrated in FIG. 4A or a support rod 421 illustrated in FIG. 4B) and a guiding wheel (e.g., a guiding wheel 413 illustrated in FIG. 4A or a guiding wheel 423 illustrated in FIG. 4B) that is rotationally connected with the support rod. For example, the guiding wheel may rotate around a central axis of the support rod. An end of the support rod may be fixedly connected with the bottom surface of the body 110; and an outer surface of the guiding wheel may touch a sidewall (e.g., the left sidewall or the right sidewall) of the guiding slot 131. In some embodiments, the pair of guiding units may be arranged side by side (e.g., along a direction parallel to the z-axis). For example, the pair of guiding units may be arranged on two sides of a central axis along the longitude direction of the body 110 of the container. An end of each support rod of the pair of guiding units may be fixedly connected with the bottom surface of the body 110 of the container 100. The outer surfaces of the guiding wheels of the pair of guiding units may touch the left sidewall and the right sidewall of the guiding slot 131 respectively. Accordingly, when the support 120 is pulled or pushed, guiding wheels of the plurality of guiding assemblies 133 may rotate in the guiding slot 131, which can reduce friction force between the guiding slot 131 and the plurality of guiding assemblies 133, such that the pull force or the push force needed by an operator (e.g., a construction personnel) for pulling or pushing the support 120 can be reduced. More descriptions regarding the guiding assembly 133 may be found elsewhere in the present disclosure (e.g., FIGS. 4A and 4B and the relevant descriptions thereof).

Further, as illustrated, the rolling mechanism 140 may include one or more rolling slots 141 and a plurality of rolling units 143.

The one or more rolling slots 141 may be disposed on the bottom surface of the support 120. In some embodiments, the one or more rolling slots 141 may be arranged along the longitude direction of the body 110 of the container 100. In some embodiments, similar to the guiding slot 131, a rolling slot 141 may have a left side wall and a right sidewall that are parallel to the x-y plane and an upper wall that is parallel to the x-z plane to form a slot shape. In some embodiments, the rolling slot 141 may be the same as or different from the guiding slot 131.

The plurality of rolling units 143 may be disposed on the bottom surface of the body 110 of the container 100. In some embodiments, the plurality of rolling units 143 may be arranged in one or more rows along the longitude direction of the body 110. For example, as illustrated in FIG. 3, the plurality of rolling units 143 are arranged in two rows along the longitude direction of the body 110 at two sides of the row corresponding to the plurality of guiding assemblies 133 and a row that partially coincides with the row corresponding to the plurality of guiding assemblies 133. In some embodiments, the plurality of rolling units 143 may be arranged at intervals along the longitude direction of the body 110.

In some embodiments, the rolling mechanism 140 may be configured to assist the support 120 to move between the entrance 111 of the body 110 and the target position in the cavity of the body 110 through the one or more rolling slots 141 and the plurality of rolling units 143. For example, the rolling slot 141 may be bucked on the rolling units 143 (which may be used as a rail) and movable along the arrangement direction of the rolling units 143, such that when the support 120 is moving (e.g., sliding) on the plurality of rolling units 143, the plurality of rolling units 143 can provide a support for the support 120 and form a sliding function with the rolling slot 141, accordingly, the support 120 can move with the medical device 103 under a relatively small force (e.g., a small push/pull force), which can improve the efficiency of loading the medical device 103 in and/or out of the container 100.

In some embodiments, a rolling unit 143 may include a mounting base (e.g., a mounting base 511 illustrated in FIG. 5) and a rolling body (e.g., a rolling body 513 illustrated in FIG. 5) that is rotationally connected with the mounting base. For example, an end of the mounting base may be fixedly connected with the bottom surface of the body 110. The outer surface of the rolling body may touch the upper surface of the rolling slot 141. More descriptions regarding the rolling unit 143 may be found elsewhere in the present disclosure (e.g., FIG. 5 and relevant descriptions thereof).

In some embodiments, the rolling mechanism 140 may include a first rolling part and a second rolling part. In some embodiments, the first rolling part may be disposed on two sides with respect to a center line of the body 110 along the longitude direction of the body 110; the second rolling part may be disposed in a vicinity of the entrance 111 of the body 110. As used herein, the vicinity of the entrance 111 may refer to a position with a distance to the entrance 111 not greater than a distance threshold. The distance threshold may be predetermined based on actual requirements of medical device transportation or historical data. For example, the distance from the position of the second rolling part to the entrance 111 may be not greater than 1 m, 0.8 m, 0.5 m, or the like, which may not be limited in the present disclosure.

Merely by way of example, as shown in FIG. 3, the first rolling part may include two rolling slots 141 arranged with respect to the center line of the body 110 along the longitude direction of the body 110 and corresponding rolling units 143. Accordingly, the weight of the support 120 and/or the medical device 103 can be dispersed (e.g., evenly shared) by the two rows of rolling units 143 and forces stressed on the two rows of rolling units 143 of the first rolling part may be uniform. That is, the support 120 and/or the medical device 103 can move steadily on the rolling units 143 of the first rolling part, which can improve the safety and stability of the medical device transportation. Further, the second rolling part may include a rolling slot 141 arranged along the center line of the body 110 (that is, the rolling slot 141 is part of the guiding slot 131) and corresponding rolling units 143. Accordingly, the second rolling part can support or hold the support 120 when the support 120 starts to enter the body 110 and reduce a pushing force for pushing the support 120 through the rolling of the rolling units 143 thereof.

In some embodiments, as the support 120 and/or the medical device 103 are moved by a forklift to load in and/or out from the entrance 111 of the body 110 of the container 100, a length of the second rolling part along the longitude direction of the body 110 may be greater than or equal to a length of a fork of the forklift for avoiding the fork of the forklift from disturbing or damaging the first rolling part during a process that the medical device 103 is loaded in and/or out from the entrance 111 of the body 110 by the fork of the forklift.

In some embodiments, the guiding slot 131 and/or the one or more rolling slots 141 may be made of any type of material such as channel steel, which is not limited in the present disclosure.

In some embodiments, in order to assist the support 120 to quickly position and adapt the guiding slot 131 and/or the one or more rolling slots 141, the guiding mechanism 130 or the rolling mechanism 140 may further include a guiding block 135. The guiding block 135 may be disposed in a vicinity of an end of the second rolling part that is close to the entrance 111 of the body 110. As used herein, the vicinity of the end of the second rolling part may refer to a position with a distance to the end of the second rolling part not greater than a distance threshold. The distance threshold may be predetermined based on actual requirements of medical device transportation or historical data. For example, the distance from the position of the guiding block 135 to the end of the second rolling part that is close to the entrance 111 may be not greater than 0.5 m, 0.3 m, 0.1 m, or the like, which may not be limited in the present disclosure.

In some embodiments, when the support 120 enters the entrance 111 of the container 100, the guiding slot 131 or the rolling slot 141 may be buckled on the guiding block 135 (e.g., the guiding block 135 may be embedded in the guiding slot 131 or the rolling slot 141). With the cooperation of the guiding block 135 and the guiding slot 131 or the rolling slot 141, the support 120 can be guided to adapt and position the guiding slot 131 and/or the one or more rolling slots 141, and then the support 120 can be driven to move to the target position in the cavity with the cooperation of the guiding mechanism 130 and the rolling mechanism 140. More descriptions regarding the guiding block 135 may be found elsewhere in the present disclosure (e.g., FIG. 7 and relevant descriptions thereof).

In some embodiments, in order to ensure the stability and safety requirements of the medical transportation, a width (e.g., a width of the guiding slot 131) of the guiding mechanism 130, a width (e.g., a width of the rolling slot 141) of the rolling mechanism 140, a distance (e.g., a distance between the guiding slot 131 and the rolling slot 141)

between the guiding mechanism 130 and the rolling mechanism 140, an interval between adjacent guiding assemblies 133, a distance between the guiding wheels of the pair of the guiding units, and/or an interval between adjacent rolling units 143 should satisfy a preset condition.

In some embodiments, the width of the guiding mechanism 130 (e.g., the width of the guiding slot 131 along the z-axis) may be within a range from 130 mm to 150 mm. For example, the width of the guiding mechanism 130 may be 130 mm, 135 mm, 140 mm, 142 mm, 145 mm, 148 mm, 150 mm, etc.

In some embodiments, the width of the rolling mechanism 140 (e.g., the width of the rolling slot 141 along the z-axis) may be within a range from 170 mm to 280 mm. For example, the width of the rolling mechanism 140 may be 170 mm, 175 mm, 180 mm, 185 mm, 190 mm, 195 mm, 200 mm, etc.

In some embodiments, the distance between the guiding mechanism 130 and the rolling mechanism 140 (e.g., the distance between the guiding slot 131 of the guiding mechanism 130 and the rolling slot 141 of the rolling mechanism 140 along the z-axis) may be within a range from 510 mm to 530 mm. For example, the distance between the guiding mechanism 130 and the rolling mechanism 140 may be 510 mm, 520 mm, 530 mm, etc.

In some embodiments, the interval between adjacent guiding assemblies 133 (e.g., along the x-axis) may be within a range from 0 to 1,600 mm. For example, the interval between adjacent guiding assemblies 133 may be 1 mm, 10 mm, 15 mm, 30 mm, 70 mm, 150 mm, 500 mm, 750 mm, 900 mm, 1,000 mm, 1,300 mm, 1,500 mm, 1,600 mm, etc.

In some embodiments, the distance between the guiding wheels of the pair of the guiding units of the guiding mechanism 130 may be within a range from 0 to 160 mm. For example, the distance between wheels of the pair of the guiding units of the guiding mechanism 130 may be 0 mm, 5 mm, 20 mm, 30 mm, 45 mm, 70 mm, 88 mm, 95 mm, 120 mm, 150 mm, 160 mm, etc.

In some embodiments, the interval between adjacent rolling units 143 (e.g., along the z-axis) may be within a range from 0 to 800 mm. For example, the interval between adjacent rolling units 143 may be 10 mm, 30 mm, 50 mm, 75 mm, 90 mm, 120 mm, 300 mm, 450 mm, 600 mm, 750 mm, 800 mm, etc.

In some embodiments, as illustrated in FIG. 2A and FIG. 2B, the container 100 or the support 120 may also include one or more damping layers 121 disposed on the upper surface of the support 120. In some embodiments, the medical device 103 may be fixed on the support 120 through the one or more damping layers 121. In some embodiments, the one or more damping layers 121 may be configured to absorb vibrations to the medical device 103, thereby reducing damages on the medical device 103 when the medical device 103 is moving or transporting with the support 120. In some embodiments, a material of the damping layer 121 may include an elastic material (e.g., a rubber) that can absorb vibrations. More descriptions regarding the damping layer 121 may be found elsewhere in the present disclosure (e.g., FIG. 6 and relevant descriptions thereof).

According to some embodiments of the present disclosure, the support 120 with the medical device 103 fixed thereon may be moved between the entrance 111 of the body 110 and the target position in the cavity under the cooperation of the guiding mechanism 130 and the rolling mechanism 140. The plurality of the guiding assemblies 133 of the guiding mechanism 130 and/or the plurality rolling units 143 of the rolling mechanism 140 may be arranged in one or more rows along the longitude direction of the body 110, which can guide and assist the movement of the support 120 accurately and steadily.

It should be noted that the descriptions of the guiding mechanism 130 and the rolling mechanism 140 are merely provided for the purposes of illustration, and not intended to limit the scope of the present disclosure. For persons having ordinary skills in the art, multiple variations and modifications may be made under the teachings of the present disclosure. In some embodiments, the guiding mechanism 130 may include two or more guiding slots 131 and corresponding guiding assemblies 133. For example, the guiding mechanism 130 may include two guiding slots 131, and the rolling mechanism 140 may include a rolling slot 141 set between the two guiding slots 131. In some embodiments, the guiding mechanism 130 may be unnecessary and the functions thereof may be achieved by the rolling mechanism 140 (e.g., two or more rolling slots 141 and corresponding rolling units 143). In some embodiments, the rolling mechanism 140 may be unnecessary and the functions thereof may be achieved by the guiding mechanism 130 (e.g., two or more guiding slots 131 and corresponding guiding assemblies 133). In some embodiments, the guiding assembly 133 may include only one guiding unit, in this situation, the outer surface of the guiding wheel of the guiding unit would touch both of the two sidewalls (e.g., the left sidewall and the right wall) of the guiding slot 131. However, those variations and modifications do not depart from the scope of the present disclosure.

Figure 4A:
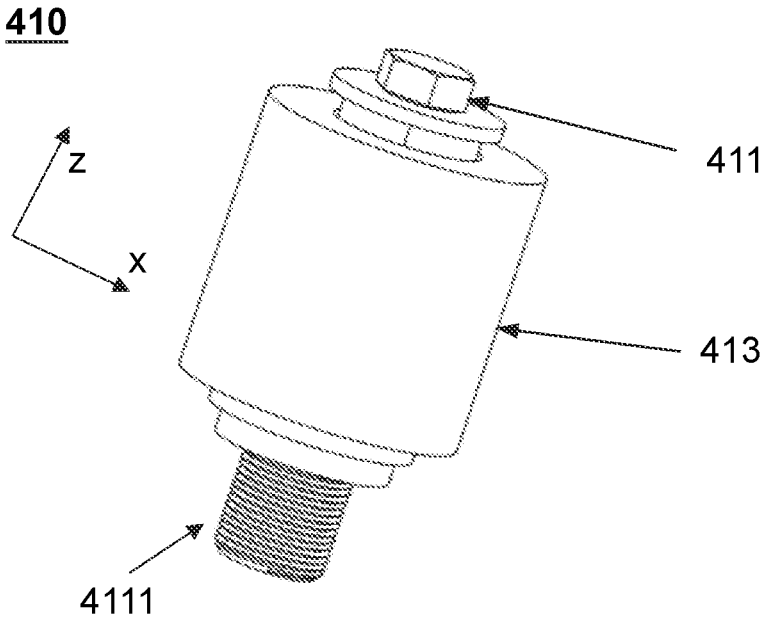
FIGS. 4A and 4B are schematic diagrams illustrating an exemplary guiding unit according to some embodiments of the present disclosure.
Figure 4B:
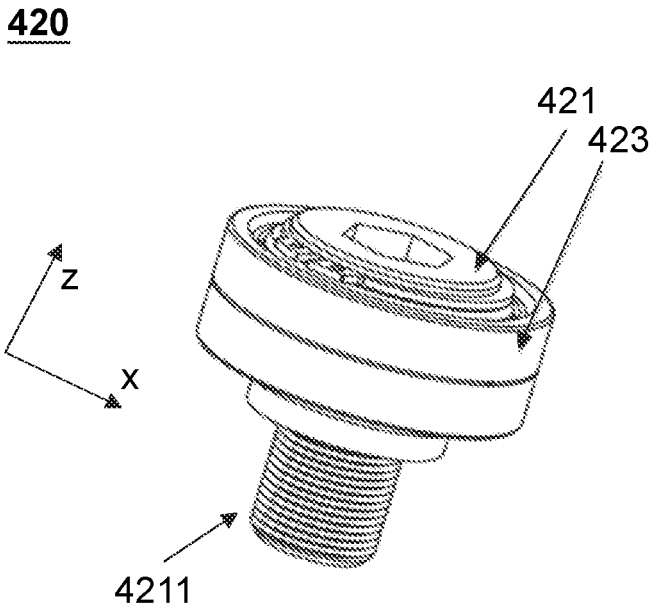

FIGS. 4A and 4B are schematic diagrams illustrating an exemplary guiding unit according to some embodiments of the present disclosure. As described above, a guiding assembly 133 of the guiding mechanism 130 may include a pair of guiding units. In some embodiments, the pair of guiding units may be arranged side by side (e.g., along a direction parallel to the z-axis). For example, the pair of guiding units may be arranged on two sides of a central axis along the longitude direction of the body 110 of the container 100. As illustrated in FIGS. 4A and 4B, the guiding units 410 and 420 may be exemplary embodiments of the guiding units of the guiding assembly 133.

As shown in FIG. 4A, the guiding unit 410 may include a support rod 411 and a guiding wheel 413 that is rotationally connected with the support rod 411. In some embodiments, an end (e.g., an end 4111) of the support rod 411 may be fixedly connected with the bottom surface of the body 110. An outer surface of the guiding wheel 413 may touch a sidewall (e.g., the left sidewall or the right sidewall) of the guiding slot 131.

As shown in FIG. 4B, the guiding unit 420 may include a support rod 421 and a guiding wheel 423 that is rotationally connected with the support rod 421. In some embodiments, an end (e.g., an end 4211) of the support rod 421 may be fixedly connected with the bottom surface of the body 110. An outer surface of the guiding wheel 423 may touch a sidewall (e.g., the left sidewall or the right sidewall) of the guiding slot 131.

In some embodiments, the support rod 411 or the support 421 may be a bolt (e.g., a flush bolt, countersunk bolt), and the guiding wheel 413 or the guiding wheel 423 may be a bearing covered on the bolt. In such cases, when the guiding assembly 133 rotates in the guiding slot 131 along with the movement of the support 120 in or out of the container 100, a friction force between the support 120 and a surface of the guiding mechanism 130 can be reduced.

It should be noted that the descriptions of the guiding units 410 and 420 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 5:
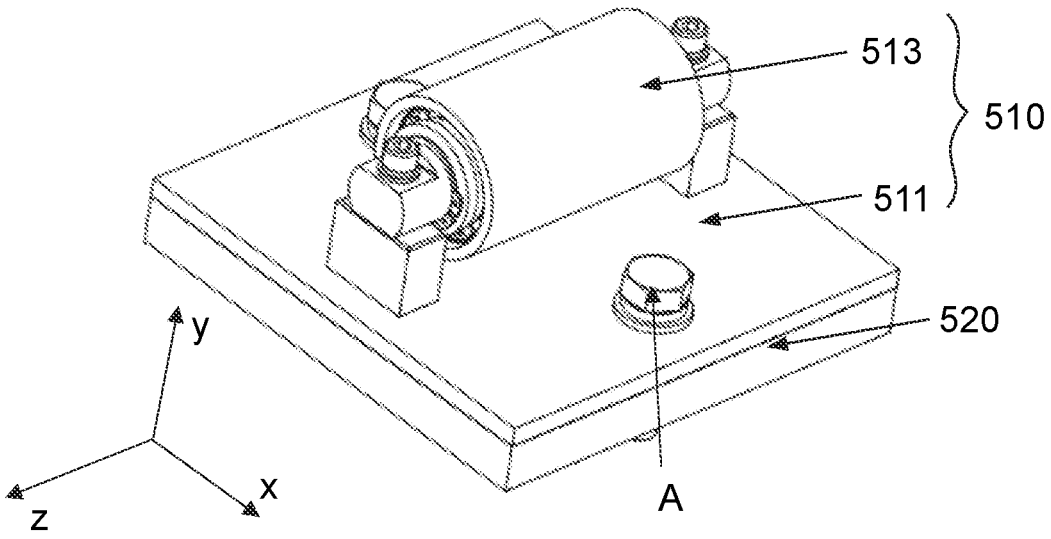
FIG. 5 is a schematic diagram illustrating an exemplary rolling unit according to some embodiments of the present disclosure.

FIG. 5 is a schematic diagram illustrating an exemplary rolling unit according to some embodiments of the present disclosure. The rolling unit 510 illustrated in FIG. 5 is an exemplary embodiment of the rolling unit 143.

As illustrated in FIG. 5, the rolling unit 510 may include a mounting base 511 and a rolling body 513 that is rotationally connected with the mounting base 511. For example, the rolling body 513 may rotate around an axis of the rolling body 513 that is parallel to the z-axis. As another example, the rolling body 513 may include a shaft (e.g., a bolt or rod) that passes through the rolling body 513 along a direction of a central axis of the rolling body 513 and the rolling body 513 may rotate around the shaft. Two ends of the shaft may be fixed on the mounting base 511 (e.g., via a screw connection, a welding connection). In some embodiments, an outer surface of the rolling body 513 may touch the upper surface of the rolling slot 141. In some embodiments, there may be a certain distance between the mounting base 511 (e.g., an upper surface of the mounting base 511) and the rolling body 513, such that the rolling body 513 can rotate freely. In some embodiments, an end (e.g., a bottom surface) of the mounting base 511 may be fixedly connected with the bottom surface of the body 110 via, for example, an adhesion connection, a welding connection, etc. Alternatively, the mounting base 511 may be fixedly connected with the bottom surface of the body 110 via a bolt connection, a screw connection (e.g., denoted by A shown in FIG. 5), etc.

In some embodiments, there may be a buffer layer 520 that is set between the mounting base 511 and the bottom surface of the body 110. The buffer layer 520 may be configured to absorb vibrations to the support 120, thereby reducing damages on the support 120 when the support 120 is moving. Further, the vibrations conducted to the medical device 103 can also be reduced, thereby improving the safety of the medical device transportation. In some embodiments, a material of the buffer layer 520 may include a material (e.g., an elastic material (e.g., a rubber)) that can absorb vibrations.

It should be noted that the descriptions of the rolling unit 510 and the buffer layer 520 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 6:
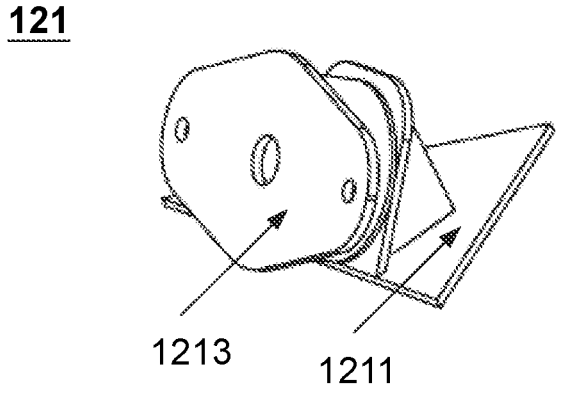
FIG. 6 is a schematic diagram illustrating an exemplary damping layer according to some embodiments of the present disclosure.

FIG. 6 is a schematic diagram illustrating an exemplary damping layer according to some embodiments of the present disclosure. As described in connection with FIGS. 2A and 2B, the damping layer 121 may absorb vibrations to the medical device 103 to reduce damages on the medical device 103 caused by the vibrations produced during the process of medical device transportation.

As illustrated in FIG. 6, the damping layer 121 may include a fixing part 1211 and a rotating part 1213. In some embodiments, the fixing part 1211 may be fixed on the upper surface of the support 120 via, for example, a welding connection, an adhesion connection (e.g., with high pressure), a bolt connection, or the like, or any combination thereof. In some embodiments, the rotating part 1213 may be connected with the medical device 103 via, for example, a contact connection (i.e., a loose connection), a connection with high pressure (i.e., a tight connection), etc.

In some embodiments, an angle of the rotating part 1213 with respect to the fixing part 1211 may be adjustable to adapt a contour shape (e.g., the shape of an outer surface) of the medical device 103, which can improve the installation stability of the medical device 103. As used herein, the angle of the rotating part 1213 with respect to the fixing part 1211 may refer to an angle between a central axis of the rotating part 1213 and a plane (e.g., a plane parallel to the upper surface of the support 120) where the fixing part 1211 is located. That is, the angle of the rotating part 1213 with respect to the fixing part 1211 may be determined based on the shape of the outer surface of the medical device 103. For example, if the shape of the outer surface of the medical device 103 is a cube, the angle of the rotating part 1213 with respect to the fixing part 1211 may be 90°. As another example, if the shape of the outer surface of the medical device 103 is cylinder and the medical device 103 is arranged in the container 100 with the axis of the cylinder is parallel to the z-axis, there may be a plurality of damping layers 121 to ensure the installation stability of the medical device 103. For instance, there may be a first rotating part (and a corresponding fixing part) and a second rotating part (and a corresponding fixing part) arranged at intervals along the longitude direction (e.g., a direction parallel to the x-axis) of the body 110, wherein a distance between the first rotating part and the central axis (e.g., an axis along the z-axis) of the medical device 103 is less than a distance between the second rotating part and the central axis (e.g., an axis along the z-axis) of the medical device 103. In this situation, a first angle of the first rotating part with respect to the corresponding fixing part may be larger than a second angle of the second rotating part with respect to the corresponding fixing part.

In some embodiments, in order to absorb the vibrations conducted to the medical device 103, a material of the fixing part 1211 and/or the rotating part 1213 may be an elastic material (e.g., rubber). In some embodiments, the material of the fixing part 1211 may be the same as or different from the material of the rotating part 1213. For example, the material of the fixing part 1211 may be a metal, such as steel, iron, etc.; and the material of the rotating part 1213 may be an elastic material such as rubber.

It should be noted that the descriptions of the damping layer 500 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 7:
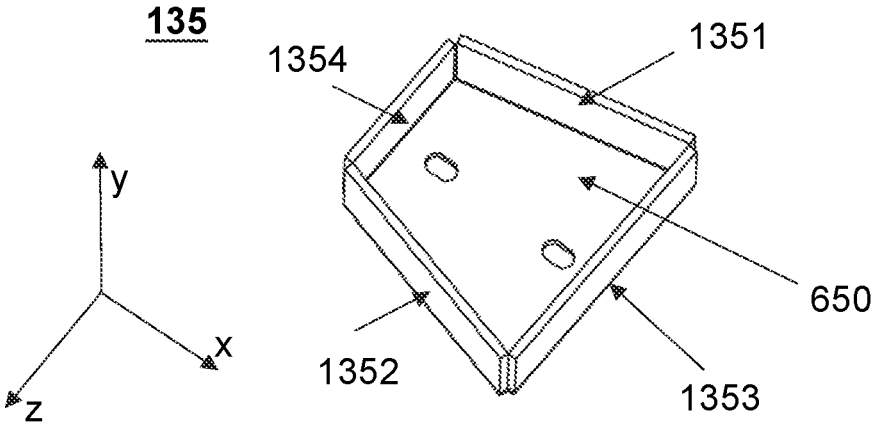
FIG. 7 is a schematic diagram illustrating an exemplary guiding block according to some embodiments of the present disclosure.

FIG. 7 is a schematic diagram illustrating an exemplary guiding block according to some embodiments of the present disclosure. As described in connection with FIG. 3, the guiding block 135 may be configured to assist the support 220 with the medical device 103 fixed thereon to quickly position and adapt the guiding slot 131 and/or the one or more rolling slots 141.

As illustrated in FIG. 7, the guiding block 135 may have a V-shape facing towards the second rolling part of the rolling mechanism 140. For example, as shown in FIG. 7, the guiding block 135 may include four sidewalls (e.g., 1351, 1352, 1353, and 1354) and a bottom surface 1355. The sidewalls 1353 and 1354 may be parallel to the y-z plane. The sidewalls 1351 and 1352 are not parallel and extensions thereof may intersect and form a V-shape. An opening of the V-shape may face toward the second rolling part. In some embodiments, the guiding block 135 may be fixed and connected with the bottom surface of the body 110 via, for example, a bolt connection, a screw connection, a welding connection, an adhesion connection, etc. In some embodiments, the material of the guiding block 135 may be metal, such as steel, aluminum alloy, iron, etc.

It should be noted that the descriptions of the guiding block 135 are merely provided for the purposes of illustration, and not intended to limit the scope of the present disclosure. For persons having ordinary skills in the art, multiple variations and modifications may be made under the teachings of the present disclosure. In some embodiments, the guiding block 135 may not include the sidewall 1354 and the sidewalls 1351 and 1352 may be directly connected with each other (e.g., extend and intersect with each other). In some embodiments, the guiding block 135 may also include an upper surface. However, those variations and modifications do not depart from the scope of the present disclosure.

Figure 8:
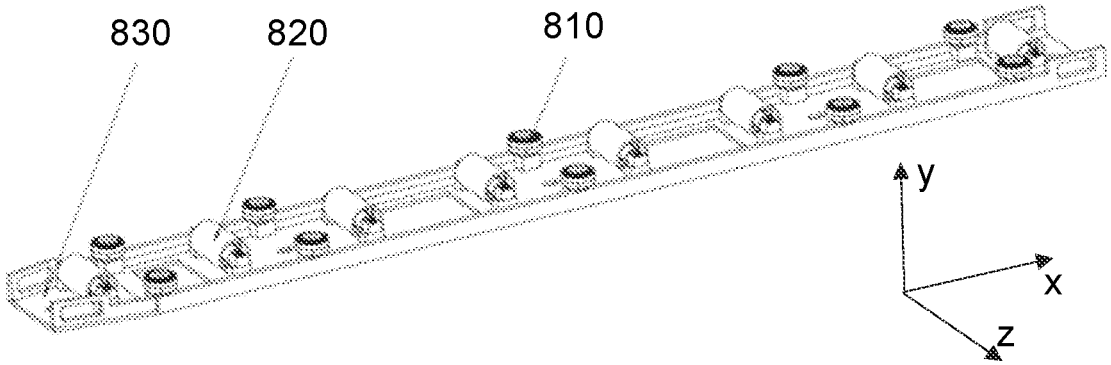
FIG. 8 is a schematic diagram illustrating an exemplary arrangement of a plurality of guiding units and a plurality of rolling units according to some embodiments of the present disclosure.

FIG. 8 is a schematic diagram illustrating an exemplary arrangement of a plurality of guiding units and a plurality of rolling units according to some embodiments of the present disclosure. As shown in FIG. 8, a plurality of guiding units 810 and a plurality of rolling units 820 are disposed in a channel 830 as a whole. The guiding unit 810 may be the same as or similar to the guiding unit 410 or 420. The rolling unit 820 may be the same as or similar to the rolling unit 143. The plurality of guiding units 810 and the plurality of rolling units 820 may be fixed on the bottom surface of the body 110 by fixing the channel 830 on the bottom surface of the body 110 via, for example, a screw connection, a welding connection, an adhesive connection, a bolt connection, etc. By introducing the channel 830, there is no need to fix each of the plurality of guiding units 810 and the plurality of rolling units 820 on the bottom surface of the body 110, thereby reducing the manufacturing cost of the container 100.

In some embodiments, as described above, a pair of guiding units 810 may form a guiding assembly which is the same as or similar to the guiding assembly 133. Accordingly, the plurality of guiding units 810 may form multiple guiding assemblies. As illustrated in FIG. 8, the multiple guiding assemblies may be arranged in a same row along the longitude direction of the body 110 as the plurality of rolling units 820. In some embodiments, the multiple guiding assemblies and the plurality of rolling units 820 may be disposed with different intervals. For example, a guiding assembly (i.e., a pair of guiding units 810) may be disposed between two rolling units 820. As another example, one or more rolling units 820 may be disposed between two guiding assemblies. In some embodiments, a distance between a guiding assembly and an adjacent rolling unit 820 may be determined based at least in part on the weight of the medical device 103 to be transported. For example, the heavier the medical device 103 is, the shorter the distance between the guiding unit assembly and the adjacent rolling unit 820 may be. In some embodiments, the multiple guiding assemblies and the plurality of rolling units 820 may share a same slot, which can reduce a count (or the number) of slots on the bottom surface of the support 120 and simplifies the structure of the container 100, thereby reducing the manufacturing cost of the container 100, which in turn can reduce the transportation cost of the medical device transportation.

It should be noted that the descriptions of arrangement are merely provided for the purposes of illustration, and not intended to limit the scope of the present disclosure. For persons having ordinary skills in the art, multiple variations and modifications may be made under the teachings of the present disclosure. In some embodiments, two or more guiding assemblies may be disposed between two rolling units 820. However, those variations and modifications do not depart from the scope of the present disclosure.

Figure 9:
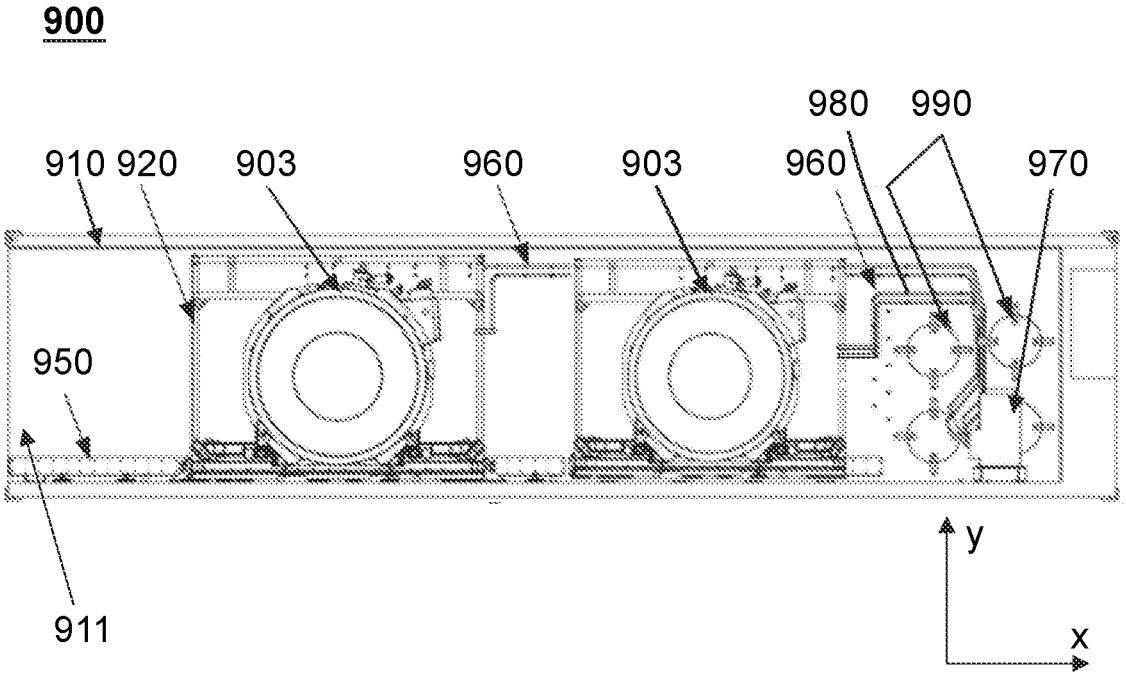
FIG. 9 is a schematic diagram illustrating an exemplary container for medical device transportation according to some embodiments of the present disclosure.

FIG. 9 is a schematic diagram illustrating an exemplary container for medical device transportation according to some embodiments of the present disclosure. The container 900 may be an exemplary embodiment of the container 100 illustrated in FIG. 1 and have a similar inner structure to the container 100. FIG. 9 is a cross-sectional view of the container 900.

In some embodiments, as described in connection with FIG. 1, a medical device (e.g., the medical device 103 illustrated in FIG. 1) that needs to be transported may be a medical device (e.g., a superconducting magnet of an MRI device) that needs to be maintained under a relatively low temperature (e.g., via liquid helium). Accordingly, a stable cooling system is needed to guarantee the superconducting environment and reduce the volatilization of liquid helium. For example, a compressor can be used as a driving unit that provides refrigeration/cooling for the superconducting magnet. Generally, the compressor may be connected to the superconducting magnet by vent pipes with a relatively large length (e.g., 20 meters). Therefore, how to arrange the compressor and the vent pipes with large length is important for the stability and efficiency of medical device transportation.

As illustrated in FIG. 9, the container 900 may include a body 910, a support 920, a guiding mechanism (not shown), a rolling mechanism (not shown), and a baffle 950, which may be similar to the body 110, the support 120, the guiding mechanism 130, the rolling mechanism 140, and the baffle 150 respectively, more descriptions may be found elsewhere in the present disclosure (e.g., FIGS. 1-8 and the relevant descriptions thereof).

In some embodiments, the body 910 may include a cavity for accommodating one or more medical devices 903 (e.g., a superconducting magnet). The medical device 903 may be moved between an entrance 911 of the body 910 and a target position in the cavity of the body 910. In some embodiments, in order to maintain a stable superconducting environment, the container 900 may further include vent pipe(s) 960 and a compressor 970.

The vent pipe(s) 960 may be configured to transmit the liquid helium and/or the gaseous helium between the medical device 903 and the compressor 970. That is, the medical device 903 may be connected with the compressor 970 via the vent pipe(s) 960. In some embodiments, a count of the vent pipes 960 may be determined based on actual needs of medical device transportation. For instance, the count of the vent pipes 960 may be twice of a count of the medical devices 903. Merely by way of example, it is assumed that there is only one medical device 903, the vent pipes 960 may include a first vent pipe and a second vent pipe, wherein the first vent pipe is used to transmit gaseous helium from the medical device 903 to the compressor 970 and the second vent pipe is used to transmit liquid helium (which is obtained by compressing the gaseous helium) from the compressor 970 to the medical device 903. Accordingly, a low temperature condition can be kept for maintaining the superconducting state of the medical device 903, and the helium may be used cyclically, which in turn can reduce transportation cost.

In some embodiments, as the length of a vent pipe 960 may be relatively long (e.g., 20 meters), in order to save space in the cavity of the body 910, at least a portion of the vent pipe 960 may be arranged and disposed on a sidewall of the body 910.

For example, a portion of the vent pipe 960 may be clamped on the sidewall of the body 910 by a buckle 980, which may be fixed on the sidewall of the body 910, such that the portion of the vent pipe 960 may be arranged and fixed on the sidewall of the body 910. More descriptions regarding the buckle 980 may be found elsewhere in the present disclosure (e.g., FIG. 10 and relevant descriptions thereof).

As another example, at least a portion (e.g., an unused, rest, or excess portion of the vent pipe 960) of the vent pipe 960 may be disposed on the sidewall of the body 910 by a wire spool 990, which may be configured to wind at least a portion of the vent pipe 960 and disposed (e.g., fixed) on a sidewall of the body 910, such that the portion of the vent pipe 960 can be fixed on the sidewall of the body 910. More descriptions regarding the wire spool 990 may be found elsewhere in the present disclosure (e.g., FIG. 11 and relevant descriptions thereof).

In some embodiments, the compressor 970 may be arranged at an end of the body 910 that is opposite to the entrance 911 of the body 910, and the wire spool 990 may be arranged on a sidewall of the body 910 at a position in the vicinity of the compressor 970. Thus, the space in the cavity of the body 910 can be saved. In addition, by the buckle 980 and the wire spool 990, the vent pipe 960 can be fixed on the sidewall of the body 910 steadily, which reduces the risk of helium leakage caused by an interface loosening between the vent pipe 960 and the compressor 970 and/or the medical device 903.

In some embodiments, since the space of the cavity of the body 910 is saved, the cavity of the body 910 may accommodate two or more medical devices 903. As illustrated in FIG. 9, there are two medical devices 903 accommodated in the cavity of the body 910. The two medical devices 903 may be fixed on the two supports 920 respectively with an interval. In some embodiments, the two supports 920 with the two medical devices 903 fixed thereon may be arranged in a row along a longitude direction of the body 910. It should be noted that the count of the medical devices 903 may be more than two, which may be determined based on the volume of the medical device 903 and the volume of the cavity of the body 910. Then, the count of the vent pipes 960 may also be increased with the increase of the count of the medical devices 903. Each of the two medical devices 903 may correspond to two vent pipes 960 that are connected with the medical device 903 and the compressor 970. For example, if the volume of the cavity of the body 910 is greater than 4 times of the volume of a medical device 903, the cavity of the body 910 may accommodate up to 4 medical devices 903. Then, the count of the vent pipes 960 may be 8.

According to some embodiments of the present disclosure, at least a portion of the vent pipe 960 may be disposed on the sidewall of the body 910 by the buckle 980, and at least a portion of the rest of the vent pipe 960 may be winded in the wire spool 990 and disposed on the sidewall of the body 910 by the wire spool 990, which can save the space in the cavity of the body 910 and more medical devices 903 can be accommodated in the container 900. In addition, after the medical device transportation is completed, the vent pipe 960 may not need to be disassembled, which can save manpower.

It should be noted that the descriptions of the container 900 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 10:
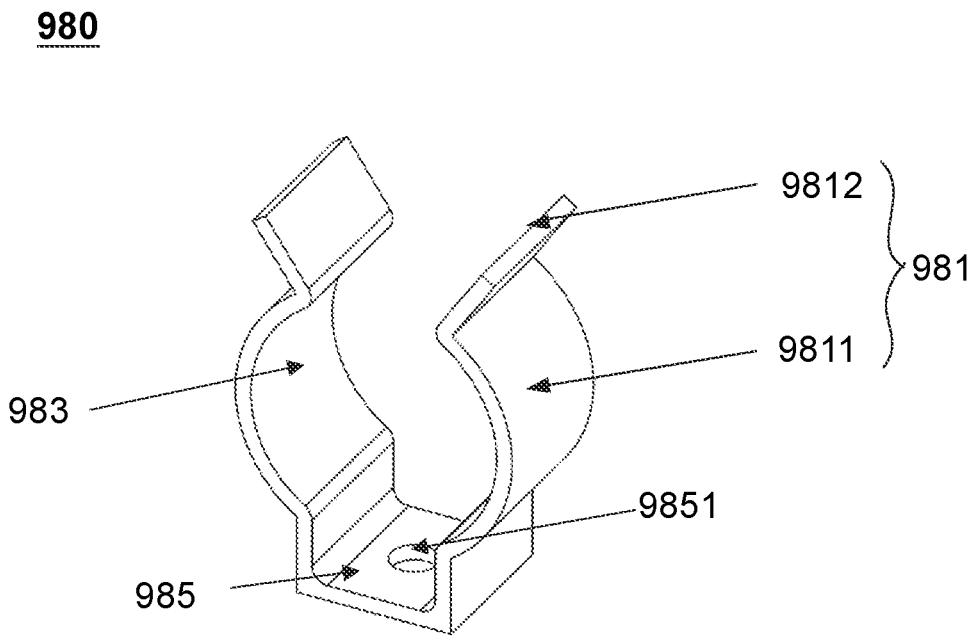
FIG. 10 is a schematic diagram illustrating an exemplary buckle according to some embodiments of the present disclosure.

FIG. 10 is a schematic diagram illustrating an exemplary buckle according to some embodiments of the present disclosure.

As illustrated in FIG. 10, the buckle 980 may include two gripping arms 981 that form a sticking slot 983 for clamping the vent pipe 960. Thus, the vent pipe 960 may be clamped in the sticking slot 983 with the two gripping arms 981. In some embodiments, the two griping arms 991 may be connected via a side plate 985. The side plate 985 may be fixed on the sidewall of the body 910 via, for example, a screw connection, a bolt connection, a welding connection, an adhesion connection, etc., such that the buckle 980 can be fixed on the sidewall of the body 910. For example, the side plate 985 may include a hole 9851 via which the buckle 980 may be fixed on the sidewall of the body 910. In some embodiments, the two gripping arms 981 may be quickly opened or closed to clamp the vent pipe 960, thus the vent pipe 960 can be quickly disassembled or installed from the sidewall of the body 110, thereby improving the installation efficiency of the vent pipe 960. In some embodiments, a plurality of buckles 980 may be used to clamp the vent pipe 960. The plurality of the buckles 990 may be arranged in a row along an arrangement direction of fixing the vent pipe 960, thus the vent pipe 960 can be fixed on the sidewall of the body 910 tightly.

In some embodiments, each of the two gripping arms 981 may include a clamping part 9811 and a slide guiding part 9812 connected with the clamping part 9811. In some embodiments, a shape of a cross-section of the clamping part 9811 may be an arc-shape (e.g., a portion of a circle), such that the sticking slot 983 can match (or be fit to) a shape of the vent pipe 960, avoiding the vent pipe 960 from slipping from the gripping arms 981. In some embodiments, the slide guiding part 9812 may tilt along a direction away from the clamping part 9811 and extend outward. Thus, the two slide guiding part 9812 may form a V-shaped structure, which can guide the vent pipe 960 to slide in and/or out of the sticking slot 983 accurately.

It should be noted that the descriptions of the buckle 980 are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 11:
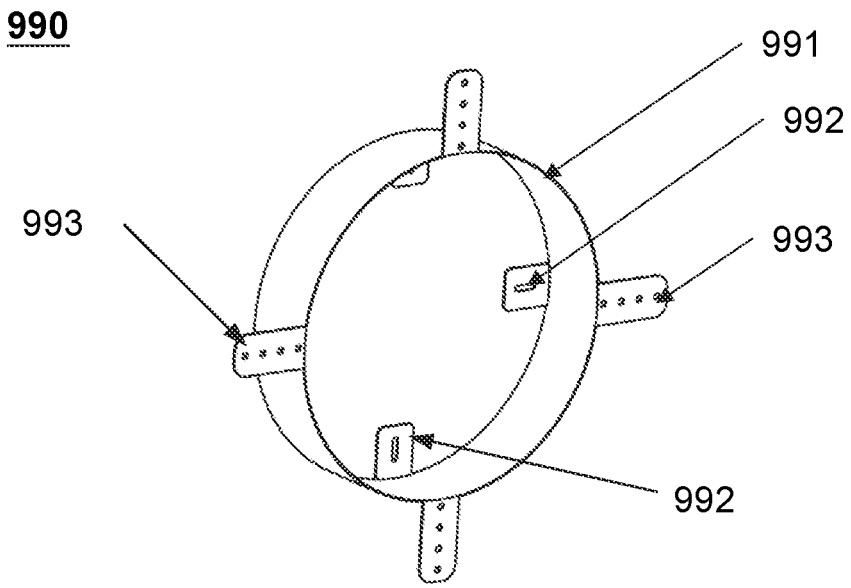
FIG. 11 is a schematic diagram illustrating an exemplary wire spool according to some embodiments of the present disclosure.

FIG. 11 is a schematic diagram illustrating an exemplary wire spool according to some embodiments of the present disclosure. As shown in FIG. 11, the wire spool 990 may include a main part 991, one or more connection parts 992 (e.g., 4 connection parts 992), one or more position limitation parts 993 (e.g., 4 position limitation parts 993), etc.

The main part 991 may include a cylinder structure, such that the vent pipe 960 can be winded on the main part 991. The main part 991 may be fixed on the sidewall of the body 910 by the connection part 992. For example, the connection part 992 may be connected with the sidewall of the body 910 via, for example, a screw connection, a welding connection, a bolt connection, an adhesion connection, etc. For instance, the main part 991 may be fixed on the sidewall of the body 910 by the connection part 992 with a plurality of nails.

The position limitation part 993 may be configured to limit a position where the vent pipe 960 is winded on the main part 991. In some embodiments, an end of the position limitation part 993 may be fixedly connected with an outer surface (e.g., an end of the main part 991 opposite to the connection part 992) of the main part 991, and another end of the position limitation part 993 may protrude outward along a radial direction of the main part 991. In some embodiments, the position limitation part 993 may also be configured to clamp the vent pipe 960 for protecting the vent pipe 960 from slipping from the wire spool 990. For example, the vent pipe 960 may be winded on an outer surface of the main part 991, and the position limitation part 993 may limit the vent pipe 960 from slipping from the main part 991. In some embodiment, the longer the length of the position limitation part 993 along the radial direction of the main part 110 is, the longer the vent pipe 960 that the wire spool 990 may wind. For example, if a length of the position limitation part 993 along the radial direction of the main part 991 is longer than four times of a diameter of the vent pipe, the vent pipe 960 may wind on the wire spool 990 by at least four circles.

In some embodiment, the one or more connection parts 992 and/or the one or more position limitation parts 993 may be arranged in intervals along the circumferential direction of the main part 991. For example, there may be a plurality of position limitation parts 993 arranged along the circumferential direction of the maim part 971, such that the vent pipe 960 may be winded on the wire spool 971 along the circumferential direction of the main part 991. As another example, there may be a plurality of connection parts 992 arranged along the circumferential direction of the maim part 971, such that the wire spool 971 can be fixed tightly on the sidewall of the body 910. In some embodiments, intervals between two adjacent connection parts 992 may be the same or different; similarly, intervals between two adjacent position limitation parts 993 may be the same or different. In some embodiments, an interval between two adjacent connection parts 992 may be the same as or different from an interval between two adjacent position limitation parts 993. In some embodiments, a count (or the number) of the position limitation parts 993 may be the same as or different from a count (or the number) of the connection parts 992. In some embodiments, a connection part 992 may be arranged to align with a position limitation part 993 as shown in FIG. 11. Alternatively, a connection part 992 may be arranged to stagger with each of the position limitation parts 993.

It should be noted that the descriptions of the wire spool 990 are merely provided for the purposes of illustration, and not intended to limit the scope of the present disclosure. For persons having ordinary skills in the art, multiple variations and modifications may be made under the teachings of the present disclosure. In some embodiments, the main part 991 may include a structure other than the cylinder structure as long as the vent pipe 960 can be winded on the main part 991. However, those variations and modifications do not depart from the scope of the present disclosure.

FIG. 12 is a schematic diagram illustrating an exemplary fixing mechanism for fixing the support according to some embodiments of the present disclosure. As described in connection with FIG. 1, FIG. 12 is an enlarged view of region A in FIG. 1.

In some embodiments, the fixing mechanism 180 may have a stair-shape. For example, as illustrated in FIG. 12, the fixing mechanism 180 may include a bottom plate 181, a side plate 182 perpendicular to the bottom plate 181, an upper plater 183 parallel to the bottom plate 181, one or more support plates 184, etc. Two ends of the side plate 182 along the y-axis may be connected with an end of the bottom plate 181 along the x-axis and an end of the upper plate 183 along the x-axis respectively via, for example, a screw connection, a welding connection, an adhesion connection, etc. The support plate 184 may be parallel to the x-y plane and connected with the bottom plate 181 and the side plate 182 for providing a support force for the support 120 with the medical device 103 fixed thereon.

In some embodiments, the bottom plate 181 may be connected with the bottom surface of the body 110 via, for example, a screw connection, a bolt connection, etc. The side plate 182 and/or the upper plate 183 may be connected with the support 120 via, for example, a screw connection, a bolt connection, etc. For example, the bottom plate 181, the side plate 182, and/or the upper plate 183 may include a plurality of holes (e.g., 1811, 1821, and 1831 respectively), via which the fixing mechanism 180 can be connected with the support 120 and the bottom surface of the body 110 via the screw connection.

In some embodiments, the support 120 may have a shape of a cuboid including four corners. Accordingly, there may be four fixing mechanisms 180 each of which is mounted in the vicinity of one of the four corners of the support 120 to ensure that the support 120 can be tightly fixed on the bottom surface of the body 110. It should be noted that a count (or the number) of the fixing mechanism(s) 180 and/or position(s) where the fixing mechanism(s) 180 are mounted may not be limited herein, and may be adjustable according to actual needs of medical device transportation. In some embodiments, operations of fixing the fixing mechanism 180 with the support 120 and/or the bottom surface of the body 110 may be performed by an operator related to the medical device transportation, for example, a transportation worker, a driver of the forklift, etc.

In some embodiments, the fixing mechanism 180 may be a structure manufactured by integral molding.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended for those skilled in the art, though not expressly stated herein. These alterations, improvements, and modifications are intended to be suggested by this disclosure, and are within the spirit and scope of the exemplary embodiments of this disclosure.

Certain terminology has been used to describe embodiments of the present disclosure. For example, the terms "one embodiment," "an embodiment," and/or "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of this disclosure are not necessarily all referring to the same embodiment. Furthermore, the particular features, structures, or characteristics may be combined as suitable in one or more embodiments of the present disclosure.

It should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

In some embodiments, the numbers expressing quantities or properties used to describe and claim certain embodiments of the application are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A container for medical device transportation, comprising:

a body including a cavity for accommodating a medical device;

a support for supporting the medical device; and a guiding mechanism for guiding the support to move from an entrance of the body to a target position in the cavity;

a rolling mechanism for assisting the support to move from the entrance of the body to the target position in the cavity, wherein the rolling mechanism includes a rolling part disposed in a vicinity of the entrance of the body; and a guiding block disposed in a vicinity of an end of the rolling part that is close to the entrance of the body, wherein the guiding block includes at least two non-parallel sidewalls, the at least two non-parallel sidewalls are configured to assist the support with the medical device fixed thereon to position and adapt the rolling part.

2. The container of claim 1, wherein the guiding mechanism includes:

a guiding slot disposed on a bottom surface of the support; and a plurality of guiding assemblies disposed on a bottom surface of the body and arranged in a row along a longitude direction of the body, wherein the guiding slot works with the plurality of guiding assemblies to guide the support to the target position.

3. The container of claim 2, wherein at least one of the plurality of guiding assemblies includes a pair of guiding units each of which includes a support rod and a guiding wheel that is rotationally connected with the support rod, wherein an end of the support rod is fixedly connected with the bottom surface of the body; and an outer surface of the guiding wheel touches a sidewall of the guiding slot.

4. The container of claim 1, wherein the rolling mechanism includes:

a rolling slot disposed on a bottom surface of the support; and a plurality of rolling units disposed on a bottom surface of the body and arranged in a row along a longitude direction of the body, wherein the rolling slot works with the plurality of rolling units to assist the support to the target position.

5. The container of claim 4, wherein at least one of the plurality of rolling units includes a mounting base and a rolling body that is rotationally connected with the mounting base, wherein an end of the mounting base is fixedly connected with the bottom surface of the body; and an outer surface of the rolling body touches an upper surface of the rolling slot.

6. The container of claim 1, wherein the rolling mechanism includes:

a second rolling part disposed on two sides with respect to a center line of the body along a longitude direction of the body.

7. The container of claim 1, wherein the guiding block has a V-shape facing towards the rolling part.

8. The container of claim 1, further comprising a baffle disposed on each of two sidewalls of the body along a longitude of the body, and a damping layer is disposed on the upper surface of the support.

9. The container of claim 1, further comprising a vent pipe, wherein at least a portion of the vent pipe is disposed on a sidewall of the body.

10. The container of claim 9, further comprising a buckle for clamping the vent pipe, wherein the buckle is disposed on the sidewall of the body.

11. The container of claim 10, wherein the buckle includes two gripping arms that form a sticking slot for clamping the vent pipe.

12. The container of claim 11, wherein each of the gripping arms includes a clamping part and a slide guiding part, the slide guiding part tilting along a direction away from the clamping part and extending outward.

13. The container of claim 9, further comprising a spool for winding at least a portion of the vent pipe, wherein the spool is disposed on a sidewall of the body.

14. The container of claim 13, wherein the spool includes:

a main part;

one or more connection parts fixedly connected with the sidewall of the body; and one or more position limitation part, an end of each of which is fixedly connected with an outer surface of the main part and another end of each of which protrudes outward along a radial direction of the main part.

15. The container of claim 14, wherein the connection parts or the position limitation parts are arranged in intervals along a circumferential direction of the main part.

16. The container of claim 1, wherein the guiding mechanism includes a guiding slot and a plurality of guiding assemblies, the guiding slot works with the plurality of guiding assemblies to guide the support to the target position, and the at least one of the plurality of guiding assemblies includes a pair of guiding units each of which includes a guiding wheel;

the rolling mechanism includes a rolling slot and a plurality of rolling units, the rolling slot works with the plurality of rolling units to assist the support to the target position, and at least one of the plurality of rolling units includes a rolling body;

a rotation direction of the guiding wheel and a rotation direction of the rolling body is different.

17. The container of claim 1, wherein the guiding mechanism includes a guiding slot and a plurality of guiding assemblies, the guiding slot works with the plurality of guiding assemblies to guide the support to the target position, and the at least one of the guiding assemblies includes a pair of guiding units each of which includes a guiding wheel;

an outer surface of the guiding wheel touches a sidewall of the guiding slot;

the rolling mechanism includes a rolling slot and a plurality of rolling units, the rolling slot works with the plurality of rolling units to assist the support to the target position, and at least one of the plurality of rolling units includes a rolling body;

an outer surface of the rolling body touches an upper surface of the rolling slot.

18. The container of claim 1, wherein the guiding mechanism includes a guiding slot and a plurality of guiding assemblies, the guiding slot works with the plurality of guiding assemblies to guide the support to the target position, the rolling mechanism includes a rolling slot and a plurality of rolling units, the rolling slot works with the plurality of rolling units to assist the support to the target position;

the guiding slot or the rolling slot is buckled on the guiding block.

19. The container of claim 1, wherein a distance between the guiding mechanism and the rolling mechanism is within a range from 510 mm to 530 mm.

20. A system for medical device transportation, comprising:

a container that includes a body including a cavity for accommodating a medical device;

a support for supporting the medical device; and a guiding mechanism for guiding the support to move from an entrance of the body to a target position in the cavity;

a rolling mechanism for assisting the support to move from the entrance of the body to the target position in the cavity, wherein the rolling mechanism includes a rolling part disposed in a vicinity of the entrance of the body; and a guiding block disposed in a vicinity of an end of the rolling part that is close to the entrance of the body, wherein the guiding block includes at least two non-parallel sidewalls, the at least two non-parallel sidewalls are configured to assist the support with the medical device fixed thereon to position and adapt the rolling part.

* * * * *